US008365491B2

(12) United States Patent
Schrunk

(10) Patent No.: US 8,365,491 B2
(45) Date of Patent: Feb. 5, 2013

(54) GROOVED PANEL COVERING FOR PROVIDING A VARYING PATTERN OF SHADING

(76) Inventor: Thomas R. Schrunk, Minneapolis, MN (US)

( * ) Notice: Subject to any disclaimer, the term of this patent is extended or adjusted under 35 U.S.C. 154(b) by 1699 days.

(21) Appl. No.: 10/900,831

(22) Filed: Jul. 28, 2004

(65) Prior Publication Data

US 2005/0005550 A1 Jan. 13, 2005

Related U.S. Application Data

(63) Continuation-in-part of application No. 10/410,060, filed on Apr. 9, 2003, now abandoned.

(51) Int. Cl.
*E04F 13/00* (2006.01)
*B44F 1/02* (2006.01)

(52) U.S. Cl. ..... 52/390; 52/311.2; 52/745.2; 52/747.11; 428/29; 428/30

(58) Field of Classification Search ..... 52/311.1, 52/311.2, 313, 316, 554, 390, 277, 747.1, 52/747.11, 745.19, 745.2; 404/19, 42; D25/113, D25/123, 125, 157, 163; 428/29, 30, 167; 359/831, 599; 362/153, 153.1
See application file for complete search history.

(56) References Cited

U.S. PATENT DOCUMENTS

| | | | | |
|---|---|---|---|---|
| 299,382 | A * | 5/1884 | Hale | 52/506.06 |
| 867,637 | A | 10/1907 | Bennett | |
| 1,133,604 | A | 3/1915 | Alcan | |
| 1,622,104 | A | 3/1927 | Fulton | |
| 1,651,248 | A * | 11/1927 | Bouin | 428/29 |
| 1,877,481 | A * | 9/1932 | Prouty | 52/316 |
| 1,996,539 | A * | 4/1935 | Dufay | 428/30 |
| 2,054,015 | A * | 9/1936 | Bruce, Jr. | 52/313 |
| 2,162,777 | A * | 6/1939 | Hagopian | 428/81 |
| 2,256,104 | A | 9/1941 | Ringle | |
| 2,651,820 | A * | 9/1953 | Hirsch | 52/391 |
| 2,714,816 | A | 8/1955 | Pennell | |
| 3,068,956 | A | 12/1962 | Cooley | |
| 3,087,577 | A * | 4/1963 | Prestia | 428/138 |
| 3,245,187 | A | 4/1966 | May | |
| 3,338,730 | A * | 8/1967 | Slade et al. | 428/142 |
| 3,384,982 | A * | 5/1968 | Herbert et al. | 434/96 |
| 3,608,261 | A * | 9/1971 | French et al. | 52/316 |
| 3,617,336 | A * | 11/1971 | Gilard et al. | 428/156 |
| 3,665,617 | A | 5/1972 | Gilbert | |

(Continued)

FOREIGN PATENT DOCUMENTS

| | | | |
|---|---|---|---|
| EP | 358495 | A1 * | 3/1990 |
| EP | 358495 | A1 * | 3/1990 |

*Primary Examiner* — Robert Canfield
*Assistant Examiner* — Jessie Fonseca
(74) *Attorney, Agent, or Firm* — Charles A. Lemaire; Jonathan M. Rixen; Lemaire Patent Law Firm, P.L.L.C.

(57) ABSTRACT

To obtain a covering on a supporting structure that has a visual appearance that varies with the angle of light from a light source impinging on the covering, there are provided parquet blocks having reference edges and top surfaces with geometric forms in parallel relationship extending to a higher elevation than the block's adjacent surface portions and extending at angles relative to the reference edges that varies from that of other blocks. The parquet blocks in plan view may be of varying shapes such as rectangular, triangular, etc. while the geometric forms may be, for example, any one of parallel ridges, lands between parallel slots, rows of selected shapes in linearly spaced, linear alignment, etc. Indicia may be provided on the blocks together with a chart having markings facilitating selecting and adhering the blocks to the supporting structure to obtain the desired pattern.

31 Claims, 7 Drawing Sheets

U.S. PATENT DOCUMENTS

| | | | | | |
|---|---|---|---|---|---|
| 4,223,499 | A | | 9/1980 | Schrunk | |
| 4,323,423 | A | | 4/1982 | Schrunk | |
| 4,722,158 | A | * | 2/1988 | Urdaneta | 52/316 |
| 4,738,059 | A | * | 4/1988 | Dean, Jr. | 52/98 |
| 4,761,931 | A | | 8/1988 | Schrunk | |
| 4,814,218 | A | * | 3/1989 | Shane | 428/102 |
| 4,877,405 | A | | 10/1989 | Stewart | |
| 5,332,191 | A | | 7/1994 | Nolan | |
| 5,713,166 | A | | 2/1998 | Couture | |
| 5,987,831 | A | * | 11/1999 | Lamberts-Van Assche | 52/316 |
| 6,253,512 | B1 | | 7/2001 | Thompson et al. | |
| 6,606,834 | B2 | | 8/2003 | Martensson et al. | |
| 6,820,383 | B2 | * | 11/2004 | Vos | 52/311.1 |
| 6,898,909 | B2 | | 5/2005 | Prat | |

* cited by examiner

G
21
F
20
53
E
1
23
2
3
4
23
5
6
7
8
9
10
11
12
24

GROOVED PANEL COVERING FOR PROVIDING A VARYING PATTERN OF SHADING

CROSS REFERENCE TO RELATED APPLICATION

This application is a continuation-in-part application of U.S. application Ser. No. 10/410,060, filed Apr. 9, 2003, now abandoned.

BACKGROUND OF THE INVENTION

This invention pertains to a covering for floors, walls and other surfaces. More particularly, this invention relates to providing a covering that has a visual effect that varies with the angle of light impinging thereon and/or the line of sight in viewing the covering. The prior art includes providing blocks or panels having smooth top surfaces with the orientation of the design on the top surfaces of at least some of the adjacent blocks being at different angles. For example, tiles have long been used for building materials to produce walls, floors and decorative objects through their regular (square, rectangular, hexagonal, triangular, etc.) shape and their color or texture, such as glossy, mate, sand, pebble, etc. Grooved materials are sometimes used for walls as a method of articulating the surface, and are sometimes used for floors as a method of increasing traction. These surfaces normally have all the grooves aligned in the same direction and give an appearance that is the same over the entire surface. As examples, grooved masonry has been used in walls as a way of articulating the surface in an aesthetically pleasing manner. This is seen in the brushing grooves of bricks or larger rectangular groove as in cast concrete walls. However, due to production considerations, these grooves are normally in only one direction, giving a similar overall appearance. While these grooves react to light, the entire surface is more or less uniform in its response due to the consistent direction of the groove. Flooring materials such as vinyl runners may also use grooves, but these grooves are all aligned in the same direction or set in opposing squares, creating an overall checkerboard pattern which gives a uniformity to the floor.

U.S. Pat. No. 6,253,512 to Thompson et al discloses using tiles of differing appearance such as color in random patterns to avoid unsightly groupings of similar patterns, including avoiding typical patterns of stair stepping or racking. U.S. Pat. No. 2,714,816 to Pennell discloses using corrugated surfaces of translucent or transparent material for breaking and spreading the direct rays and reflected rays to the interior. The purpose is to utilize the transmitted light for better and less distracting illumination. The corrugations are substantially parallel to the base.

Such prior art structures do not provide differences in shading of some of the blocks in an assembly of blocks relative to others with the angle from the source light that impinges on the blocks varying to provide unique patterns such as with the present invention.

SUMMARY OF THE INVENTION

The covering of this invention may be made of parquet blocks wherein the block material may be composed of any one of a number of different materials, for example, carpet or other types of fabric, masonry, stone, wood, ceramic, vinyl or other types of plastic, metal or other type of material. The blocks in plan view may be of any one of a number of geometric shapes, for example squares, triangles, hexagons, or rectangles. The top of each block has top surface portions of varying elevations as a result of providing geometric forms, for example, ridges, squares, triangles, ovals, hexagons or rectangles with the forms being in generally parallel relationship. Desirably, each block is provided with more than one geometric form of the same shape in a preselected orientation relative to one another and extending to a different elevation than adjacent parts of the block. Sets of blocks have the orientation of the geometric forms arranged at different preselected angles, for example the form orientations of different sets of blocks being arranged at different specific angles such as ten degree increments. The geometric forms extend across at least a major part of the top surface of the block. The parquet blocks may be adhered to a supporting surface in various selected patterns with the visual appearance of the pattern varying with the angle of light from a light source impinging on the top surface.

The parquet blocks may be a series of tiles having grooves or ridges with various angles that, when assembled together, are capable of producing aesthetically pleasing images which change in appearance with change in light direction as well as a change in the location of the viewer. Such parquet blocks may be arranged to produce an infinite variety of patterns which change in appearance with a change in the light angle impinging of the blocks and/or the angle of viewing the arrangement. The grooves or ridges in the individual blocks are at specific angles, such as the grooves or ridges aligned with a reference edge of a square (a differential of 10 degrees), while other blocks have grooves or ridges at different angular increments relative to their reference edge such as 10 degrees clockwise, 20 degrees, 30 degrees, etc. By placing these blocks in the desired angle change sequence, an overall pattern can be developed to produce flowing abstract images or literal images. Angled light impinging on the surfaces of these blocks displays areas of brightness and areas of shade, which produce a secondary image that changes as the angle of light impinging on the surfaces changes. When viewed from a defined vantage point at a slight angle relative to the surface, the grooves or ridges which are aligned with line of sight of the viewer will be especially prominent producing a tertiary image, and when the viewer moves, other grooves or ridges will become prominent, changing the image as well. In both cases, the patterns produced by the light and shade and the line of sight will change location in the over all pattern of the arrangement of the blocks. Thus, by using the blocks of this invention it is possible to provide images which flow over the designed surface.

When the surfaces of the block arrangement, with the block reference edges being most closely adjacent to the arrangement reference edge and parallel to the arrangement reference edge, and the arrangement surface being lit from one side, the grooves or ridges respond differently depending on their angle relative to the source of the light. Those blocks having grooves aligned with the light source will be completely filled with light and will present the brightest area(s) of the overall assembly. Those blocks having grooves perpendicular to the light will have full or nearly full shade in the grooves and will be the darkest area(s) of the arrangement. In an example of a vertical grooved wall that is generally aligned with the sun rise and the sun set and has a series of blocks exposed to the sun with grooves at different angles, the blocks having horizontal grooves, other than possibly the ends of the horizontal grooves closely adjacent blocks having grooves extending other than horizontally, will be fully "lighted" at sunrise while those with vertical grooves will have full shade, and those other blocks having grooves intermediate the horizontal and vertical would be proportionately brighter the more nearly the grooves extend horizontally. As the sun moves through the day, the entire series of lighted and shaded grooves will change whereby there is produced a continuously changing image, till at noon the vertical grooves will be the brightest and the horizontal grooves will be full or nearly fully shaded. When a light source impinging on the blocks moves rapidly relative to the blocks, for example the lights of a moving car, more dramatic and compelling changes can be seen.

An object of this invention is to provide new and novel blocks adherable or mountable to a base (supporting surface) in selected patterns to have a visual impression which varies with the angle of light impinging on the block pattern. In furtherance of the last mentioned objective, it is another object of this invention to provide blocks of lustrous material with grooves to provide visual effects that vary with the angle of light from a light source impinging thereon. Another object of this invention is to provide new and novel parquet blocks adherable or mountable to supporting structure to provide a pattern whereby, as the angle of light impinging on the pattern varies, some areas of the pattern appear lighter and other areas appear darker and then as the angle changes, the lighter areas appear darker and the darker areas appear lighter.

DESCRIPTION OF THE INVENTION

Figures 1, 2:
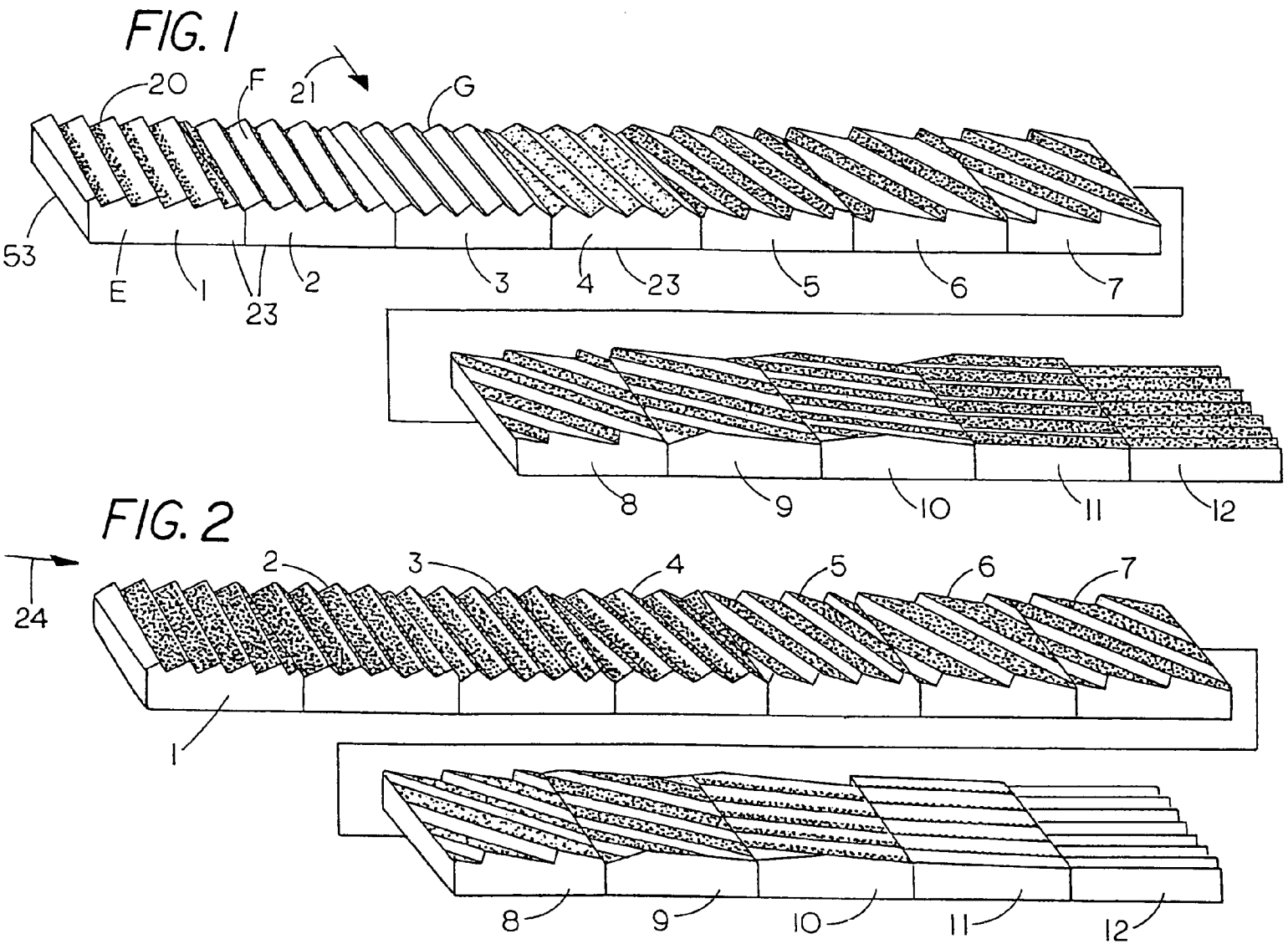
FIG. 1 is a perspective view of an array of parquet blocks of the first embodiment with the increment angles of the ridges of adjacent blocks being of about 10 degrees and there being progressively increased shading on the blocks both to the left and right of the third block from the left, when the source of light is in a vertical plane parallel to the ridges.
FIG. 2 is an array similar to that of FIG. 1 other than the source of light impinges thereon at about a right angle to that shown in FIG. 1 wherein the shading decreases both to the left and right of the third block from left.
Figure 3:
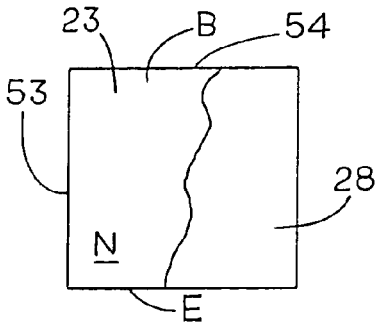
FIG. 3 is bottom view of one of the parquet blocks of the first embodiment.

Each parquet block B of the first embodiment of the invention has a top surface of varying elevations to provide ornamental geometric forms F which comprise a plurality of ridges or flat upper surfaces 20 that extend generally parallel relative to one another. Thus, the ridges or flat upper surfaces have crests or lands 20A that are at a higher elevation than the troughs 20B between the ridges, i.e. the crests being at a higher elevation than the adjacent trough surface portions. Desirably, the ridges extend all the way across the block. As one example, the difference in the elevation of the crest relative to the trough of the ridge may be a tenth of an inch, but may be greater or smaller, depending on the desired shading effects to be obtained with the variation of the angle of light from a source of light that impinges on the blocks or the size of the image. The bottom surface 23 of each block may be provided with a self adhesive covered by a release paper 28 that is removed prior to laying the block on the support surface, or if not provided with a bottom surface having a self adhesive thereon, then a suitable adhesive may be used to adhere the block to the supporting surface 25. If the blocks are rectangular or square, they have a reference edge E, an opposite edge 54, and opposite edges 53 extending between edges E and 54 to form the parametric edge of the block. To be mentioned is that in place the blocks having crests and troughs, the blocks may be provided with grooves as referred to below with there being sets of grooved blocks having grooves extending at angles such as described above relative to ridges.

Figure 5:
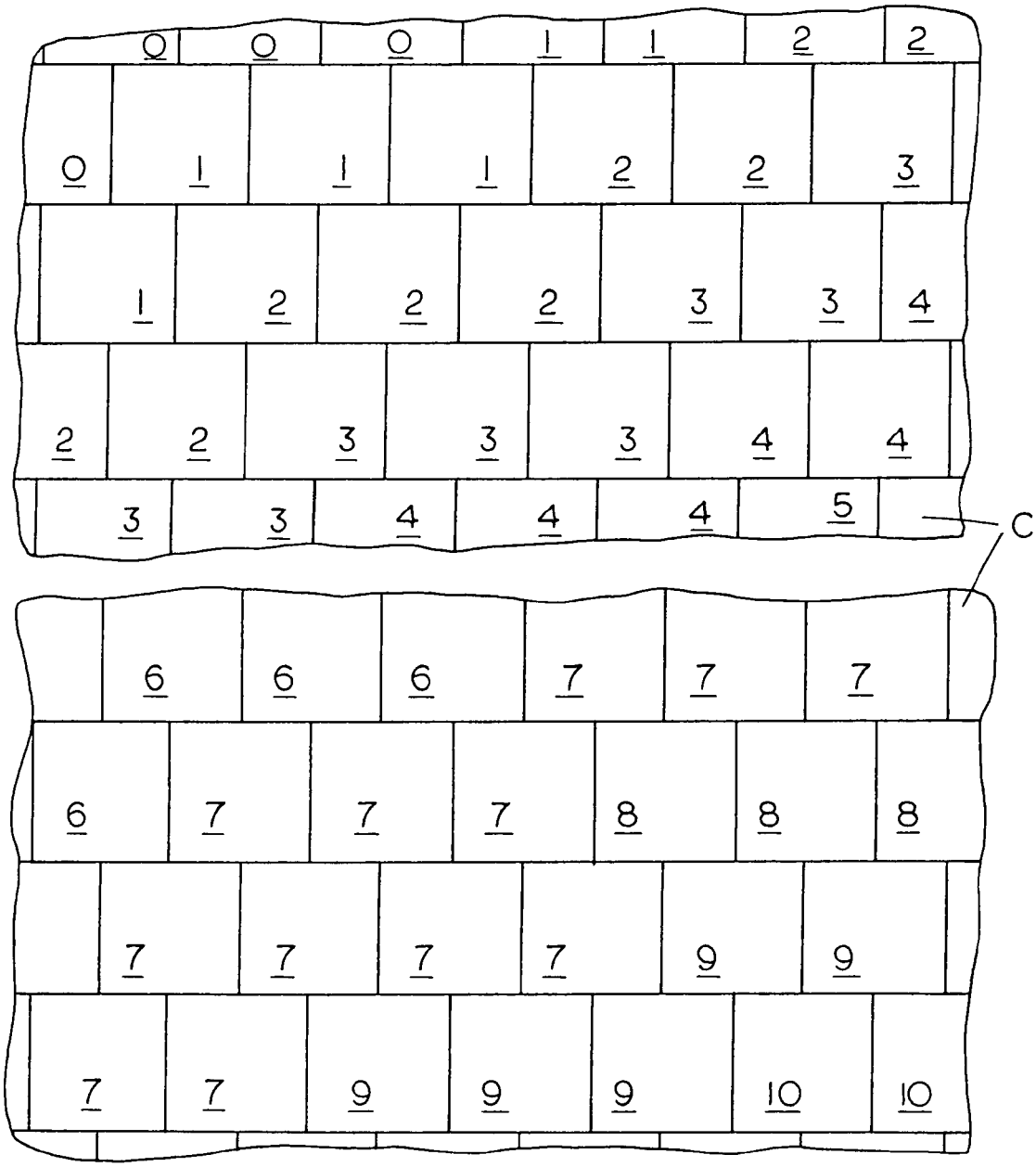
FIG. 5 a fragmentary view of a chart used in laying out the pattern of FIG. 4.

In order to provide a pattern (design) on supporting structure 25 (for example a floor, wall, the ground, item of furniture, etc.) having a visual appearance, for example images, that vary with the variance of angle of light impinging on the pattern on the supporting structure, there is provided a plurality of sets of blocks B with the angle of orientation of the ornamental geometric forms F of each set relative to their reference edges E of each set being at different angles. There is provided an array of blocks with the angle of orientation of the ornamental forms varying in increments from 0 degrees to 180 degrees relative to reference edges E of the blocks, FIG. 1 showing an array of blocks 1 through 12 with the angle of variation being in ten degree increments from only 70 degrees to 180 degrees and the reference edges being in the same vertical plane. It is to be understood that the increment of variation may be other than 10 degrees. It is to be understood that the number N on the blocks of different sets of blocks of the array of blocks could be 1 through 18 if orientation of forms on adjacent blocks varied by ten degree increment indicated in FIG. 1, it being noted that there is shown only one block of each set. In FIG. 5, the reference number 0 indicates a 60 degree angle of orientation of forms F. Desirably, the numbers N are provided on the bottom surfaces or on an edge of each block.

Figure 6:
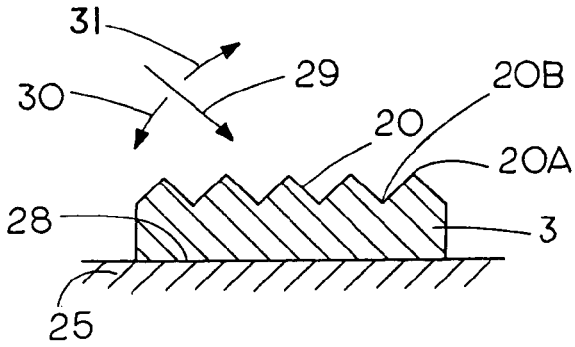
FIG. 6 is a cross sectional view of a parquet block of the first embodiment that is taken in a vertical plane parallel to the direction of the extension of the ridges.
Figure 7:
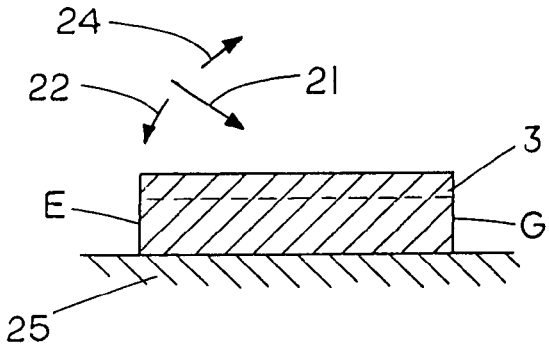
FIG. 7 is a cross sectional view of a parquet block of the first embodiment that is taken in a vertical plane perpendicular to the direction of the extension of the ridges.

With the light from the source of light downwardly impinging on the array of blocks of FIG. 1 at an angle, indicated by arrow 21 as generally shining in a direction from block edges G toward edges E, in a vertical plane generally parallel to the direction of extension of the ridges of block 3 and the angle being less than 90 degrees relative to the bottom surfaces 23 of the blocks, there is a progressively greater degree of block top surface shading (less reflection of light) in the direction from block 3 to block 12 and also in the opposite direction from block 3 toward block 1 as a result of the crests (or flat upper surfaces) being at a higher elevation than the troughs. Further, if the angle indicated by arrow 21 from 90 degrees in the direction of arc 22 (see FIG. 7), or in the opposite direction of arc 24 from 90 degrees, there is greater top surface shading of blocks in a direction away from block 3. On the other hand, if the downwardly impinging of light on the array of blocks in the direction of arrow 29 is at an angle in a plane generally perpendicular to the direction of extension of the ridges of block 3 with the angle being less than 90 degrees relative to the bottom surface of block 3, there is progressively less block top surface shading (greater reflection of light) in the direction from block 12 to block 3 and lesser shading from block 3 toward. block 1. Further, if the light angle indicated by arrow 29, other than 90 degrees, varies in the direction of arc 30 or in the opposite direction of arc 31 from 90 degrees (see FIG. 6), there is greater block top surface shading along the array of blocks from block 12 to block 3. It is to be noted if the downwardly impinging of light on the blocks is at 90 degrees relative to the array bottom surfaces, there will be no variation of shading such as indicated above but as the angle of impinging of light on the array more nearly approaches being parallel to plane of the array bottom surfaces, the greater the degree of shading other than for the block that has ridges that are parallel to the vertical plane extending to the source of light. Thus, assuming sunlight impinges on the blocks, the pattern of shading will vary from sunrise to sunset with the highest contrast being at sunrise and sunset. Also, there would be a variance with the seasons with the greatest difference in shading (different areas of the pattern being highlighted) being at the summer and winter solstices while the fall and spring equinoxes would give relatively the same visual image. The sunrise and sunset during the rest of the year impinges on the pattern at variable angles that provide variable visual impressions with the changes of the angles. Further, even it sunlight does not impinge on the blocks, as one varies their position relative to an array of blocks such as shown in FIG. 1, the pattern of shading visualized will vary.

Figure 4:
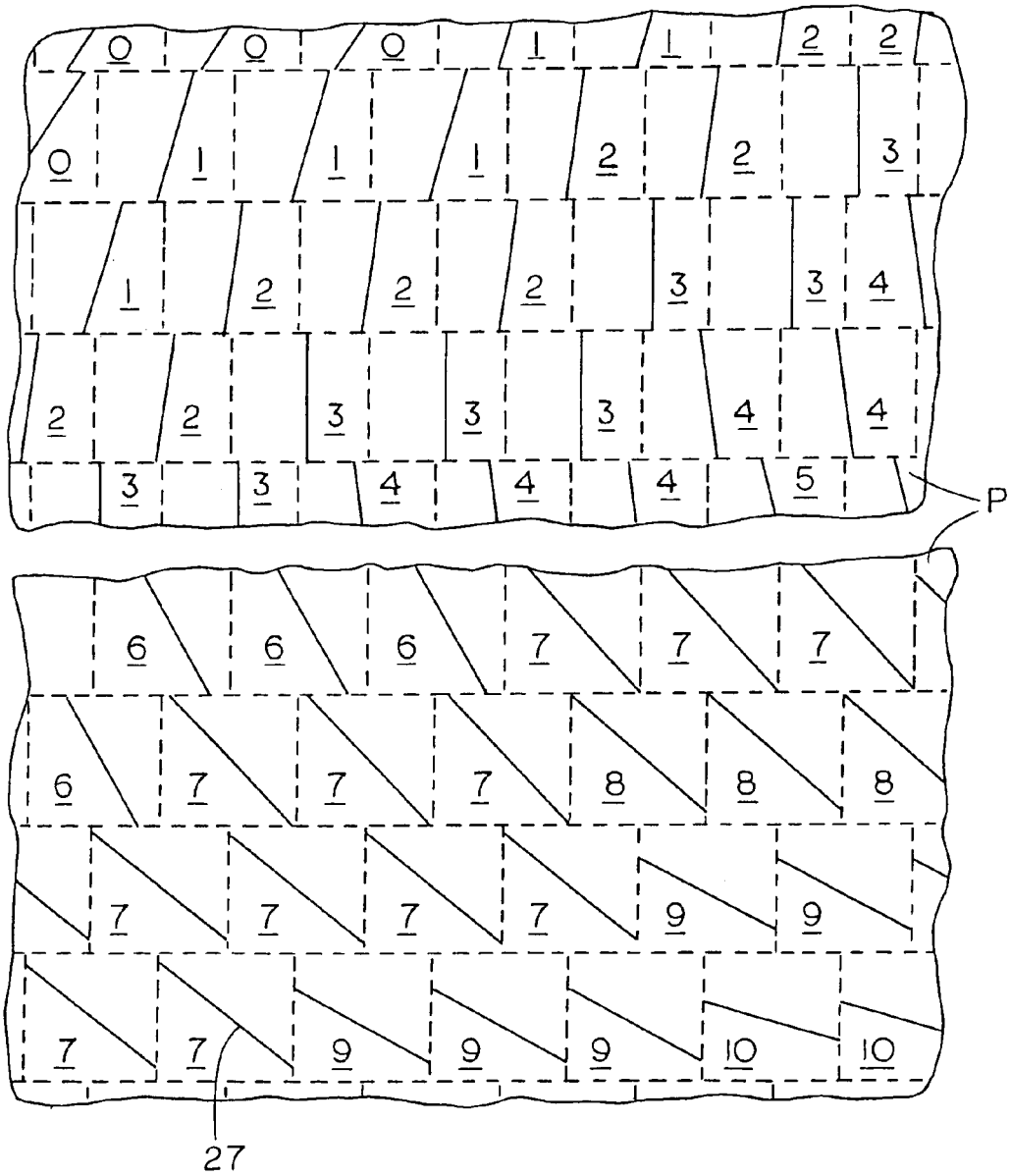
FIG. 4 is a fragmentary plan view of a pattern with the first embodiment of parquet blocks being shown by dotted lines and the angle of orientation of the geometric forms on the blocks relative to their reference edges being represented by solid lines and with an intermediate portion of the pattern being broken away.

Taking advantage of the difference of shading obtained with an array of blocks such as shown in FIG. 1, one can provide a pattern P of shading by laying the selected blocks to provide an arrangement such as shown in FIG. 4. The general angle of orientation of the forms F on the blocks adhered to the supporting structure 25 is represented by the solid lines 27 in FIG. 4.

To facilitate laying the blocks in the desired pattern, there is provided a chart C with marking thereon which advantageously shows the rows of blocks and includes indicia such as shown in FIG. 5 indicating the arrangement of blocks with the desired orientation of geometric forms thereon that are to be adhered to the supporting surface. The reference edges of the blocks are arranged to be in a preselected orientation to an edge of the chart C. Assuming that there are sets of blocks corresponding to the array shown in FIGS. 1 and 2, then the number N of the bottom surface of the blocks corresponds to the angle of orientation of the forms F of the top surface of the respective block. The numbers appearing on the chart correspond to the blocks having the desired angle of orientation of geometric forms thereon to provide the desired pattern. Thus, the numbers shown in FIG. 5 correspond to the number of the blocks as set forth in FIG. 1 that are used to obtain the pattern P of FIG. 4.

Advantageously, one of the edges of the blocks is considered as a reference edge E and may be provided with appropriate indicia to facilitate orienting the blocks in appropriate direction relative to the supporting surface prior to adhering the blocks to the supporting surface 25. The indicia used can be other than the numbers shown in the drawings and normally would not be provided on the top surfaces of the parquet blocks. Even though FIG. 4 shows numbers on the blocks, it is to be understood that usually no such numbers would be provided on the top surfaces of the blocks that are adhered to the supporting structure 25.

With reference to each of the embodiments described herein, the material used in making the blocks can be, for example carpet, ceramic, vinyl, concrete or other materials wherein the geometric forms are generally in parallel linearly oriented rows and are at or extend to a higher elevation than the adjacent part of the top surface of the block. By arranging the blocks of selected angles of orientation of geometric forms, a pattern can be developed to create a design on a floor, wall or other supporting surfaces. In forming the desired pattern, the blocks are adhered to a supporting surface 25, desirably with the edges of adjacent blocks being in abutting relationship. The parquet blocks of appropriate material can be used in airport concourses, shopping malls, etc and if desired, by selecting the appropriate pattern, the blocks can be arranged on a supporting surface to provide a directional pathway. That is, a number of blocks having the same angle orientation can be adhered to a supporting surface in transverse abutting relationship, for example, use blocks 3 in transverse and longitudinal abutting relationship if the pathway is straight ahead. On either transverse side of the straight ahead part of the pathway, blocks having different angles of orientation than blocks 3 would be on transverse opposite sides of the blocks 3 forming the straight ahead part of the pathway.

Where the pathway turns, blocks with different angles of orientation of geometric forms can be used to extend across the rest of the transverse width of the pathway and progressively further transversely offset in the direction of the turn to form a continuation of the straight ahead portion of the pathway. Blocks having angles of orientation of geometric forms different from those used for the turning portion of the pathway are adhered to the supporting surface on each transverse side of the turning portion of the pathway.

Figure 8:
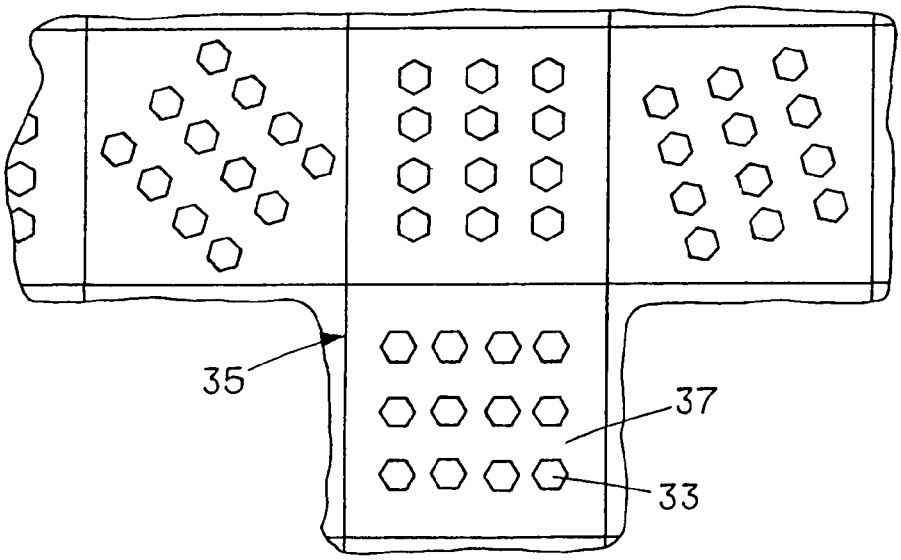
FIG. 8 is a plan view of a second embodiment of a plurality of parquet blocks with geometric forms thereon different from that of the parquet blocks of FIG. 1.

Referring to FIG. 8, there is shown geometric forms other than ridges F that can used and that rows of blocks vertical above one another do not have to be transversely offset such as shown in FIG. 4. That is, in the second embodiment of FIG. 8, the geometric forms 33 on the blocks, generally designated 35, in plan view are of hexagonal shapes. The forms 33 extend to a higher elevation than the adjacent surrounding block surface part 37. Each block includes a plurality of linear rows of hexagonal forms 33 thereon, there being several forms 33 in each row. The forms in each row extend across the major portion of the block even though the forms in each row are linearly spaced from one another. The angles of orientation of the rows of forms 33 may be varied from block to block or of the same orientation with the adjacent blocks. Thus, blocks with geometric forms in linear rows of geometric forms at angles of the rows of other blocks being of varying orientation may be adhered to the supporting surface to provide the desired pattern. Further, the blocks in vertically adjacent rows of blocks as shown in the drawings can be transversely offset as shown in FIG. 4, or vertically aligned such as shown in FIG. 8.

Figure 9:
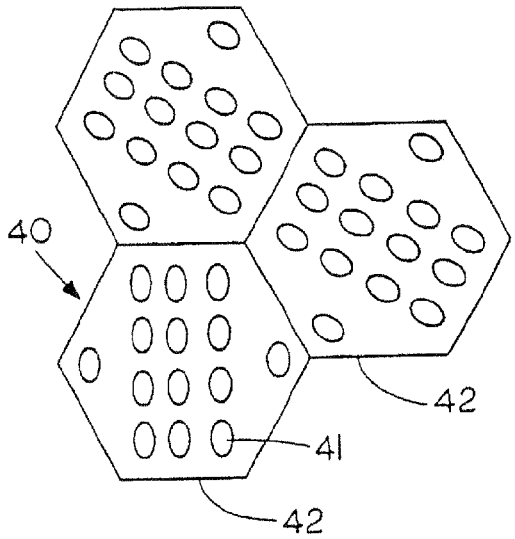
FIG. 9 is a plan view of a third embodiment of a plurality of parquet blocks of a different shape from that of FIG. 1 and having geometric forms thereon that differ from those of the first and second embodiments.

Even though the parquet blocks of the first and second embodiment are shown as being square, it is to be understood the blocks in plan view could be of other shapes, for example triangular, rectangular, hexagonal or other geometric shapes. As shown in FIG. 9, the third embodiment parquet blocks, generally designated 40, in plan view are hexagonal. Each block 42 of the plurality of blocks 40 has a plurality of generally parallel rows of oval shaped geometric forms 41 thereon that extend to a higher elevation than the adjacent top surface portions surrounding the ovals. There are several ovals in each row with the ovals in each row being in generally linear alignment. There can be provided sets of blocks with the blocks of each set having rows of geometric forms thereon at different angles of orientation relative to a reference edge than the rows of the ovals of others sets of blocks, for example such as set forth relative to the first embodiment.

Lustrous materials (ones having grain) such as wood, textiles, metals, etc, visually appear to be their brightest when the grain is perpendicular to the light source. Parquet blocks having normal surfaces, ones without grain, such as painted sources are unaffected by the direction of light impinging on the blocks.

Figure 10:
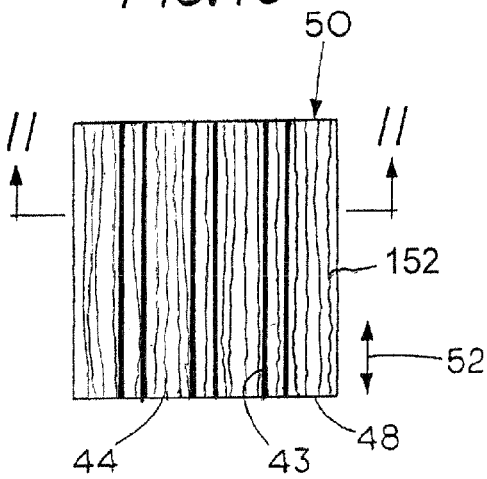
FIG. 10 is a plan view of a fourth embodiment of a parquet block made of a lustrous material and the grain being diagrammatically represented by an arrow.
Figure 11:
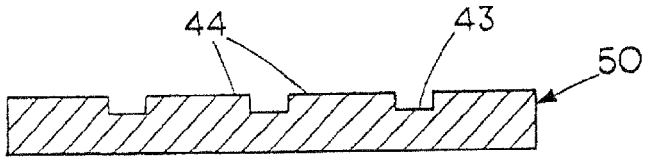
FIG. 11 is a cross sectional view that is generally taken along the line and in the direction of the arrows 11-11 of FIG. 10.
Figure 12:
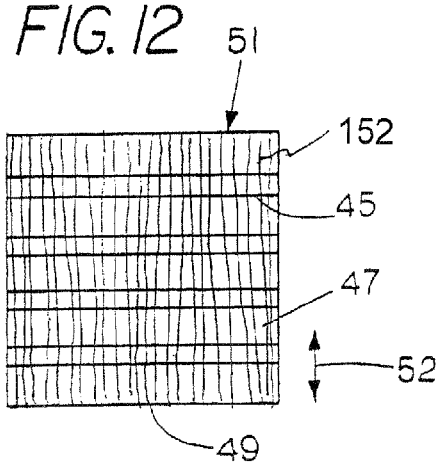
FIG. 12 is a plan view of the fifth embodiment of a parquet block made of a lustrous material and the grain being diagrammatically represented by an arrow.

The parquet blocks of the fourth and fifth embodiments, respectively generally designated 50 and 51 are made of lustrous material and the general direction of the grain is indicated by the double arrow 52 for each of these embodiments( the grain itself is schematically indicated in FIGS. 10 and 12 by 152). The block 50 is provided with a plurality of parallel grooves 43 extending across the entire block. The bottom of the grooves, which are shown in FIG. 11 as being rectangular in transverse cross section, are at a lower elevation than the top surface lands (geometric forms) 44 of the block 50. Each groove extends between adjacent lands. When the vertical plane of the direction from which the light that impinges on the block emanates from a light source that is parallel to the grain and the grooves 43, the grooves are filled with light and will be at their brightest while the top surface between the grooves would be at their normal illumination. On the other hand, when the vertical plane of the direction from which the light that impinges on the block emanates is perpendicular to the grain and the grooves 43, the grooves are filled with shadows and will be at their darkest while the top surfaces between the grooves would be at their brightest and giving the maximum luster.

The blocks 50 would have distinct bright and dark areas, the degree of brightness and darkness depending upon the angle of light from the light source impinging on the blocks. This gives unique and subtle effects as the dark areas produced by the shadows in the grooves would be a simple lowering of illumination while the brighter areas of luster would be in the particular color spectrum of the material being used (wood, textile, metal, etc.) specifically emphasizing that color. That is, as the angle of the light source impinging on the block 50 becomes more nearly perpendicular to the direction of extension of the grooves 43, the greater the amount of shadows in the grooves. The amount of shadows in the grooves in part depends on the depth of the grooves and the angle of the light impinging on the grooves.

A lustrous material with grooves 45 at 90 degrees relative to the grain such as indicated in FIG. 12 would give a different effect from that with the fourth embodiment. The bottom of the grooves 45 are at a lower elevation than the lands 47 with the grooves extending between adjacent lands 47. When the grooves 45 are parallel with the light source, the grooves would be filled with light and at their brightest while the grain (top surface 47) would display maximum luster. When the grooves 45 are perpendicular relative to the light source, the grooves would be full of shadows and aaaat their darkest while the top surfaces 47 would be at normal illumination. This would give maximum differential to the light/dark areas of the design.

As to each of the fourth and fifth embodiments, there may be provided a plurality of sets of blocks, each of the sets having the grooves extending at a different angle of inclination relative to the reference edges 48 and 49 respectively and extending across the blocks. Thus, there may be provided a set of blocks corresponding to each of the sets of the first embodiment, indicia (not shown) on the back surface of each of the blocks and a chart such as indicated relative to FIG. 5 for obtaining the desired pattern (design) on the supporting surface.

In order to more fully appreciate what can be achieved using the blocks of this invention and arranging them in patterns such that desired designs predominate when viewed with different lines of sight, attention is directed to FIGS. 13-16. One example of a pattern of blocks of this invention wherein the appearance changes with the angle of viewing patterns of blocks can be seen by referring to FIGS. 13 and 14. For purposes of simplifying the showing the effects of the change of the viewing angle (line of sight), it will be assumed that the pattern is the arrangement of blocks shown in these FIGS. 13-16 are being viewed outdoors on a cloudy day during daylight. Further, it will be assumed that the blocks of FIGS. 13-16 are blocks such as referred to FIGS. 1 and 2 or are blocks that have grooves oriented at angles such as depicted for the ridges. The reference numbers shown for the various blocks represents the angles orientation of the ridges or grooves of the blocks, the reference numbers of only some of the blocks being shown in the drawings while the solid lines for each block indicating the angle of orientation of the plurality of ridges or grooves for each block. The only difference in the blocks in the given pattern is that the grooves on their top surfaces are different. The part of the pattern illustrated is made up of blocks with the ridges or grooves of a number of blocks is at different angles than adjacent blocks. The reference numbers 1-3 correspond to the same numbered blocks of FIGS. 1 and 2 while reference numbers 13, 14, 15, 16, and 17 are to indicate that the ridges or grooves of the blocks are oriented at 50 degrees, 40 degrees, 30 degrees, 20 degrees and 10 degrees respectively relative to their reference edges. The heavier (darker) solid lines indicating the angle of orientation of the ridges or grooves extend at the same or substantially the same angle that the viewer observes the blocks.

Figure 14:
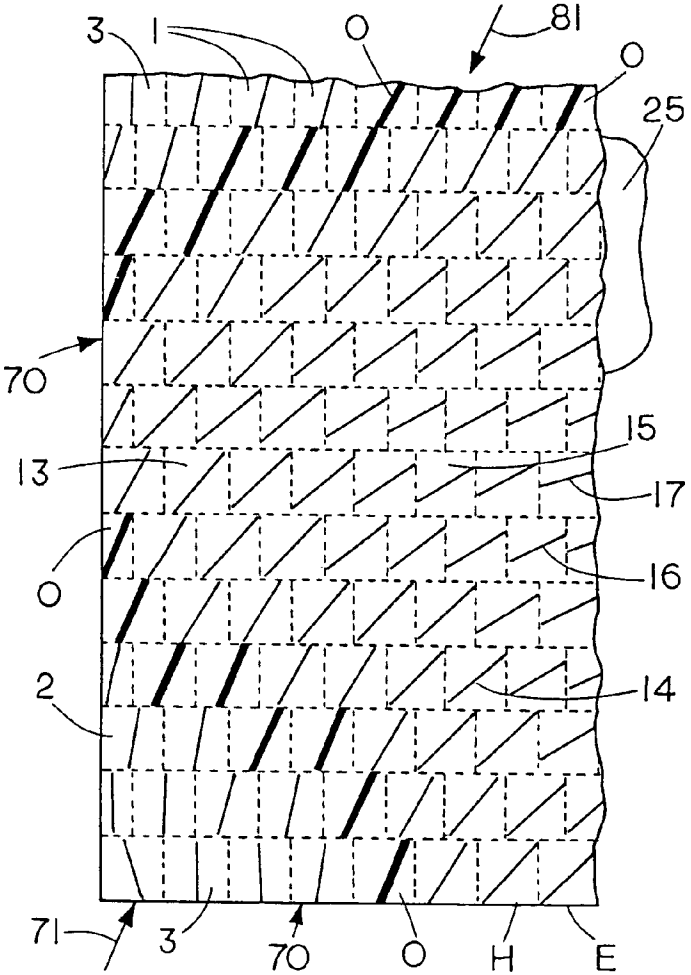
FIG. 14 is a view that is the same as FIG. 13 other than the pattern is being viewed at a different angle than that indicated for FIG. 13.
Figure 13:
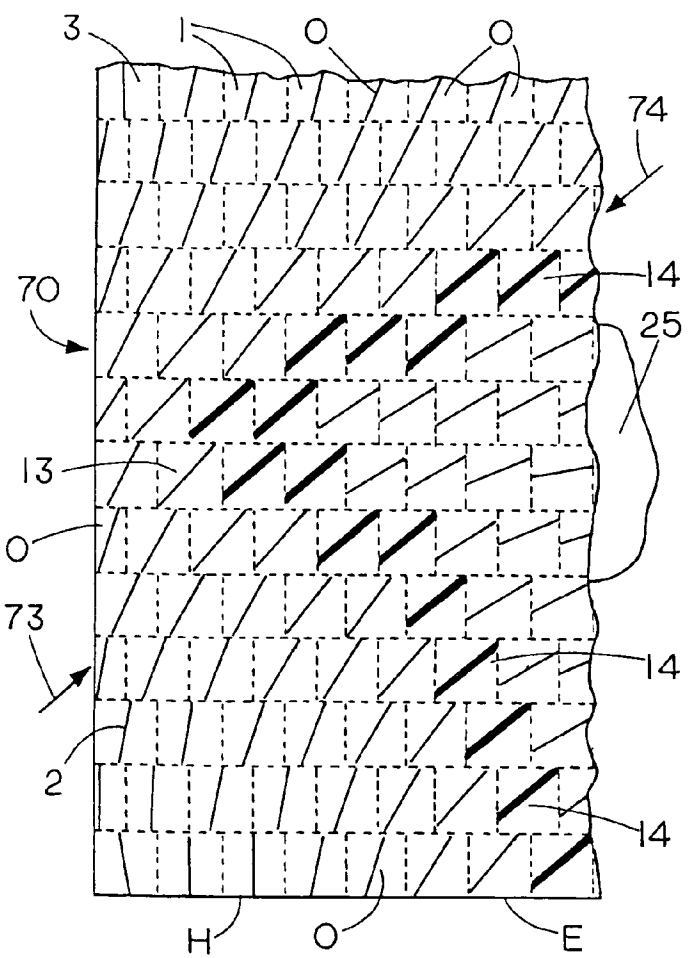
FIG. 13 is a fragmentary plan view of a second pattern with the first embodiment of parquet blocks being shown by dotted lines and the angle of orientation of the geometric forms on the blocks relative to their reference edges being represented by solid lines.

For FIGS. 13 and 14, the pattern of blocks, generally designated 70, has the reference edge H within the reference edge E of each of the blocks is the block edge that is most closely adjacent to and parallel to the pattern reference edge. Thus, whether the viewer views the pattern along a line of sight from the angle represented by reference number 74 or an angle that is represented by reference number 73 that is at 180 degrees relative the angle 74, the blocks most prominent are the same. That is the blocks 14 having ridges or grooves extending at the same angle that they are viewed from (line of sight) appear brighter (stand out more predominately or conspicuously) than the other blocks that have some other orientation of the ridges or grooves. However, if the only difference is the line of sight (angle of viewing) of viewing FIG. 14 from that of FIG. 13, blocks 0 are brighter or stand out more than the other blocks since the ridges or grooves of blocks 0 are aligned with the viewing angle 71 or 81 and thus are more prominent than other blocks. Thus, there is provided different abstract designs that are more prominent when viewed from one angle than another angle. Other blocks would be more prominent if the pattern is viewed along a different line of sight. Thus, it may be understood that the appearance of the pattern 70 and the design presented by the most prominent blocks varies with the line of sight from which it is viewed and the orientation of the ridges or grooves relative to other blocks in the pattern.

Figure 15:
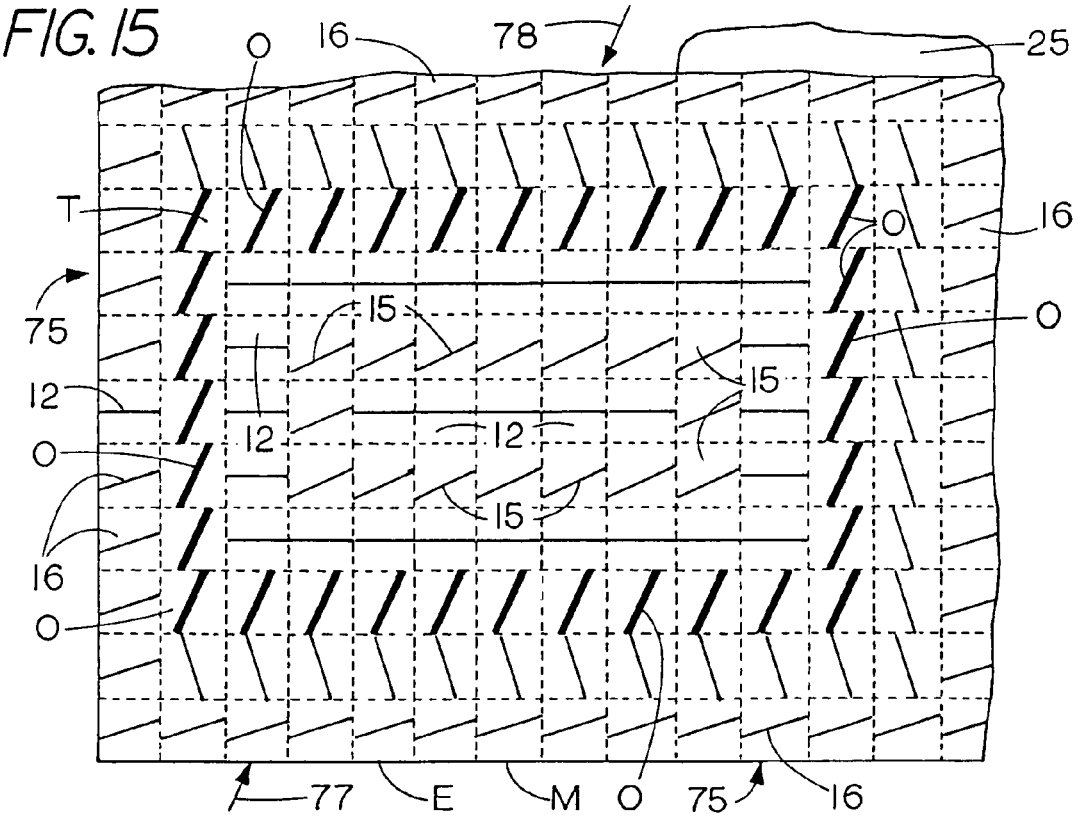
FIG. 15 is a fragmentary plan view of a third pattern with the first embodiment of parquet blocks being shown by dotted lines and the angle of orientation of the geometric forms on the blocks relative to their reference edges being represented by solid lines.
Figure 16:
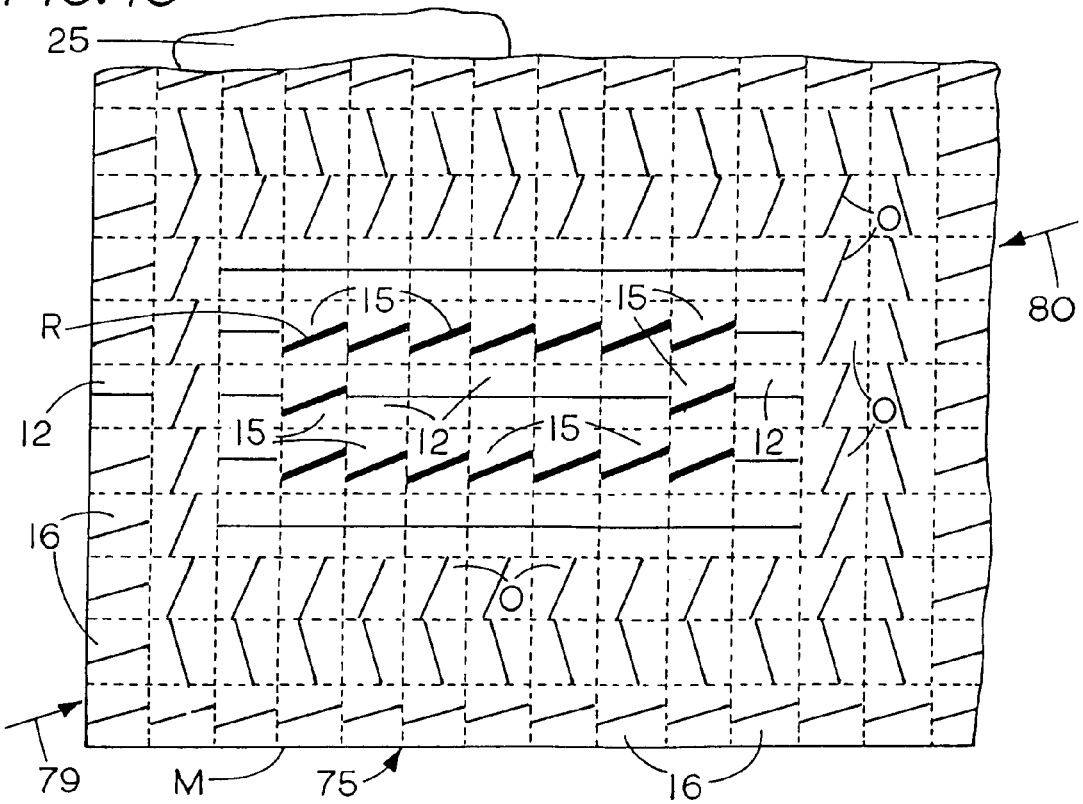
FIG. 16 is a view that is the same as FIG. 15 other than the pattern is being viewed at a different angle than that indicated for FIG. 15.

Referring to FIGS. 15 and 16, there is shown another pattern, generally designated 75, having a reference edge M and wherein the blocks are arranged such that the blocks 0 when viewed along a line of sight 77 or 80 are brighter to provide appearance of the perimeter of a rectangle T than the blocks abutting against the blocks 0 that form the permeter. The ridges of the blocks abutting against the blocks 0, which have their ridges oriented to extend at 60 degrees relative their reference edges, have their ridges or grooves oriented at angles other than sixty degrees relative to the pattern reference edge. It is to be noted that the pattern 75 has blocks 15 arranged to provide the appearance of a rectangle R when the line of sight is at one of angles 79 and 80 which are different than angles 77 and 78 and that blocks 0 no longer appear to be the brightest. Thus, for example, when one walks from a position to view pattern 75 at a line of sight 78 to a position to view the pattern from a line of sight 79, one moves from a position that the larger rectangle T predominates to a position that the smaller rectangle R predominates and is within the confines of the blocks that defined rectangle T.

It is believed that it is obvious from the above, one can lay out charts for adhering blocks of this invention to have any one of an infinite number of abstract images, one example being that of FIGS. 13 and 14 or literal images, one example being that of FIGS. 15 and 16, where the visual appearance changes with the angle of light that impinges on pattern of blocks according to the chart and/or changes with the line of sight in viewing the pattern.

In the event the blocks are of shapes other than square or rectangular, they can be provided with reference edges with appropriate indicia to facilitate properly adhering them in proper relationship to the pattern reference edge. In the event the blocks are other than square or rectangular, the blocks may be provided with appropriate indicia, desirably on other than the top surface, and an appropriate chart to indicate the positioning of the blocks on the supporting surface and adhered thereto.

What is claimed is:

1. A plurality of sets of parquet blocks that are adapted for being adhered to a supporting surface in a desired pattern with each block including edges that define the perimeter of the block, including a reference edge, a top surface with a plurality of pointed ridges each having a triangular cross section at its local maximum, wherein the pointed ridges are in a generally parallel relationship, there being at least a first set, a second set, and a third set of blocks with the blocks in each of the three sets having the pointed ridges extending at a preselected angle relative to its reference edge that is at a different angle than the angles of extension of the pointed ridges of blocks of each of the other sets, the blocks being adherable to the supporting surface with adjacent blocks having edges in abutting relationship and the blocks from more than two sets being adhered to the supporting surface in a preselected array to provide patterns of shading that vary with the change of at least one of the angle of light impinging on the array and the angle of sight in viewing the array, wherein at least one of the pointed ridges are pointed ridges that extend clear across the blocks and the blocks of each set are of the same parametric dimension as the blocks of the other sets.

2. The plurality of sets of parquet blocks of claim 1, wherein the blocks are made of a lustrous material having a grain extending in a given direction, and the plurality of pointed ridges are generally parallel to the given direction.

3. The plurality of sets of parquet blocks of claim 1, wherein the blocks are made of a lustrous material having a grain extending in a given direction, and the plurality of pointed ridges are generally perpendicular to the given direction.

4. The plurality of sets of parquet blocks of claim 1, wherein the blocks of each set of blocks have indicia thereon that is different from the indicia on other sets of blocks.

5. The plurality of sets of parquet blocks of claim 4, in combination with a chart having a design thereon, the chart having markings thereon corresponding to the block indicia to facilitate selecting blocks to be used to obtain the desired pattern.

6. The plurality of sets of parquet blocks of claim 1, wherein the pointed ridges on each block extend along substantially equally spaced lines that are generally parallel relative to one another.

7. The plurality of sets of parquet blocks of claim 1, whrerein the pointed ridges are arranged in a plurality of generally straight linear rows of pointed ridges with the rows being in a parallel relationship.

8. The plurality of sets of parquet blocks of claim 1, further comprising the supporting surface, wherein the plurality of sets of parquet blocks are adhered to the supporting surface in a pattern that places a second parquet block that is a member of the second set of parquet blocks adjacent to a first parquet block that is a member of the first set of parquet blocks and places a third parquet block that is a member of the third set of parquet blocks adjacent to the second parquet block such that the preselected angle of the plurality of pointed ridges incrementally changes from the first parquet block to the adjacent second parquet block and from the second parquet block to the adjacent third parquet block resulting in a pattern of shading that varies from the standpoint of a stationary viewer observing the parquet blocks illuminated by a moving light source.

9. The plurality of sets of parquet blocks of claim 1, wherein the blocks are made of a material selected from the group consisting of carpet and ceramic.

10. The plurality of sets of parquet blocks of claim 1, wherein the preselected angle for the first set is about ten degrees different from the preselected angle of the second set and the preselected angle for the second set is about ten degrees different from the preselected angle of the third set.

11. The plurality of sets of parquet blocks of claim 1, wherein each one of the plurality of pointed ridges has the triangular cross section as taken from a first groove bottom on one side of the pointed ridge to a top of the pointed ridge and then to a second groove bottom on an opposite side of the pionted ridge and then back to the first groove bottom.

12. The plurality of sets of parquet blocks of claim 1, wherein the blocks are made of a material comprising concrete.

13. An apparatus comprising:

a plurality of parquet blocks adhered to a support structure, wherein outer faces of the plurality of parquet blocks form a surface that includes a plurality of areas including a first area, a second area, and a third area, wherein the second area is adjacent to the first area, wherein the third area is adjacent to the second area, and wherein the plurality of parquet blocks include:

a first parquet block having a face that forms the first area, wherein the first parquet block has a first plurality of pointed ridges that are each pointed at a local maximum, wherein the first plurality of pointed ridges are substantially parallel ridges that extend in a first direction at a first angle relative to a reference line and substantially cover the face of the first parquet block, and wherein a plurality of the first plurality of pointed ridges extend clear across the first parquet block, a second parquet block having a face that forms the second area, wherein the second parquet block has a second plurality of pointed ridges that are each pointed at a local maximum, wherein the second plurality of pointed ridges are substantially parallel ridges that extend in a second direction at a second angle relative to the reference line, wherein the second angle is different than the first angle, and wherein a plurality of the second plurality of pointed ridges extend clear across the second parquet block, and a third parquet block having a face that forms the third area, wherein the third parquet block has a third plurality of pointed ridges that are each pointed at a local maximum, wherein the third plurality of pointed ridges are substantially parallel ridges that extend in a third direction at a third angle relative to the reference line and substantially cover the face of the first parquet, wherein the third angle is different than the first angle and different than the second angle, and wherein a plurality of the third plurality of pointed ridges extend clear across the third parquet block, wherein the plurality of areas on the support structure are arranged such that the angles of the directions of the respective plurality of pointed ridges of the first, second and third areas incrementally change from the first angle of the first area's plurality of pointed ridges to the second angle of the adjacent second area's plurality of pointed ridges and from the second angle of the second area's plurality of pointed ridges to the third angle of the adjacent third area's plurality of pointed ridges, and wherein the incremental changes in the angles of the plurality of pointed ridges results in a pattern of shading that varies from the standpoint of a stationary viewer observing the surface illuminated by a moving source of light.

14. The apparatus of claim 13, wherein each of the plurality of parquet blocks is made of a material comprising concrete.

15. The apparatus of claim 14, wherein the incremental changes in the angles of the plurality of pointed ridges also results in a pattern of shading that varies from the standpoint of a moving viewer observing the surface illuminated with a stationary light source.

16. The apparatus of claim 13, wherein each of the plurality of parquet blocks is made of a material comprising wood.

17. The apparatus of claim 13, further comprising a plurality of walls including a first wall, wherein the support structure forms at least a part of the first wall.

18. The apparatus of claim 13, further comprising a floor, wherein the support structure forms at least a part of the floor.

19. The apparatus of claim 13, wherein differences in brightness of light form a plurality of regions of the surface of the plurality of parquet blocks provide a directional pathway, wherein at least part of the pathway is straight ahead, wherein the directional pathway is defined by a first subset of the plurality of parquet blocks that together have a fourth plurality of pointed ridges, wherein ridges of the fourth plurality of pointed ridges that define the straight ahead part of the pathway have angles of orientation that are substantially equal to one another, and wherein ridges of a second subset of the plurality of parquet blocks that are located on either transverse side of the straight ahead part of the pathway have different angles of orientation than the fourth plurality of pointed ridges forming the straight ahead part of the pathway.

20. The apparatus of claim 13, wherein the incremental change of the preselected angle from the first parquet block to the second parquet block is about ten degrees, the incremental change of the preselected angle from the second parquet block to the third parquet block is about ten degrees, and the incremental change of the preselected angle from the first parquet block the third parquet block is about twenty degrees.

21. The apparatus of claim 13, wherein each of the plurality of parquet blocks is made of a material selected from the group consisting of carpet and ceramic.

22. An apparatus comprising:

a supporting surface; and means for forming a visual effect on the supporting surface, wherein the visual effect includes an incrementally changing varied pattern of shading as at least one of an angle of light from a light source impinging on the apparatus and a line of sight in viewing the apparatus varies.

23. The apparatus of claim 22, wherein the means for forming the visual effect is made of a material comprising concrete.

24. The apparatus of claim 22, wherein the means for forming the visual effect include a plurality of adjoining tiles, each having a plurality of pointed ridges, wherein each of the plurality of pointed ridges on each tile of the plurality of adjoining tiles has an angle of extension, and wherein the angle of extension for the ridges on the plurality of adjoining tiles of the surface varies at regular angle increments of about ten degrees from tile to adjacent tile.

25. The apparatus of claim 22, wherein the means for forming the visual effect include:

a plurality of sets of tiles, including a first set, a second set, and a third set, wherein each tile has a top surface having a plurality of pairs of adjoining walls that extend across the block, and a corresponding plurality of pointed ridges, each pair of walls extending to a respective pointed ridge at a local maximum of the pair of adjoining walls wherein for each of the plurality of ridges at least one wall of the pair of walls that adjoin that ridge is non-perpendicular and non- parallel relative to a plane formed across a top of the plurality of pointed ridges, and means for adhering the plurality of sets of tiles to the supporting surface in a desired pattern such that each ridge extends at a preselected angle relative to a reference line, and wherein the blocks are configured to provide an incremental change of the preselected angle of the plurality of pointed ridges from a first tile of the plurality of sets of tiles to a second tile of the plurality of sets of tiles and from the second tile to a third tile of the plurality of sets of tiles, wherein the incremental change in angle results in a pattern of shading that varies from the standpoint of a stationary viewer observing the tiles when adhered to the surface and illuminated by a moving light source.

26. The apparatus of claim 22, wherein the incrementally changing varied pattern of shading changes in about ten-degree increments.

27. The apparatus of claim 22, wherein the means for forming the visual effect include a plurality of parquet blocks.

28. A grooved panel covering for providing a varying pattern of shading, the covering including:

a plurality of grooved tiles adhered to a supporting surface in a desired pattern, wherein each one of the plurality of grooved tiles has a top surface with a plurality of pointed ridges each having a triangular cross section at its local maximum, wherein the pointed ridges are in a generally parallel relationship, wherein each one of the plurality of grooved tiles has a plurality of edges that define the perimeter of the tile, the plurality of edges including a reference edge, wherein the plurality of grooved tiles includes a first set having at least two of the plurality of grooved tiles, a second set having at least two of the plurality of grooved tiles, and a third set having at least two of the plurality of grooved tiles, wherein the at least two tiles in each of the three sets have the pointed ridges extending at a preselected angle of extension relative to its reference edge that is at a different angle than the angles of extension of the pointed ridges of tiles of each of the other sets, wherein the tiles are adhered to the supporting surface with adjacent tiles having edges in abutting relationship, wherein the tiles from more than two sets are adhered to the supporting surface in a preselected array to provide patterns of shading that vary with the change of at least one of the angle of light impinging on the array and the angle of sight in viewing the array, and wherein at least one of the pointed ridges on each of the plurality of grooved tiles adhered to the supporting surface are pointed ridges that extend clear across the tiles.

29. The apparatus of claim 28, wherein the plurality of tiles comprise a plurality of parquet blocks.

30. A method for providing a varying pattern of shading on a surface of a grooved article, the method including:

forming a plurality of grooved tiles to have a top surface with a plurality of pointed ridges each having a triangular cross section at its local maximum, wherein the pointed ridges are in a generally parallel relationship, wherein at least one of the pointed ridges on each of the plurality of grooved tiles are pointed ridges that extend clear across the tiles, wherein each one of the plurality of tiles includes edges that define the perimeter of the tile, the edges including a reference edge, wherein the plurality of grooved tiles include a plurality of sets of tiles including a first set, a second set, and a third set, wherein the pointed ridges on the tiles in each of the plurality of sets extend at a preselected angle relative to its reference edge that is at a different angle than the angles of extension of the pointed ridges of tiles of each of the other sets, wherein the tiles are adherable to a supporting surface with adjacent tiles having edges in abutting relationship, wherein the at least one of the pointed ridges are pointed ridges that extend clear across the tiles and the tiles of each set are of the same parametric dimension as the tiles of the other sets; and adhering the tiles to the supporting surface in a desired pattern such that the tiles from more than two sets are adhered to the surface in a preselected array to provide patterns of shading that vary with the change of at least one of the angle of light impinging on the array and the angle of sight in viewing the array.

31. The method of claim 30, wherein the adhering of the tiles includes incrementally changing the preselected angle of a plurality of adjacent tiles in about ten-degree increments.

* * * * *